US012252298B2

(12) United States Patent
Fleming et al.

(10) Patent No.: US 12,252,298 B2
(45) Date of Patent: Mar. 18, 2025

(54) ENVELOPE AND TEMPLATE FOR FORMING SAME

(71) Applicant: Packsize LLC, Salt Lake City, UT (US)

(72) Inventors: Benjamin Thurie Fleming, Salt Lake City, UT (US); Connor Robert Pehrson, Salt Lake City, UT (US)

(73) Assignee: PACKSIZE LLC, Salt Lake City, UT (US)

( * ) Notice: Subject to any disclaimer, the term of this patent is extended or adjusted under 35 U.S.C. 154(b) by 0 days.

(21) Appl. No.: 17/731,820

(22) Filed: Apr. 28, 2022

(65) Prior Publication Data

US 2022/0348383 A1 Nov. 3, 2022

Related U.S. Application Data

(63) Continuation-in-part of application No. 29/816,638, filed on Nov. 23, 2021, now Pat. No. Des. 1,039,043, which is a continuation-in-part of application No. 29/786,154, filed on May 28, 2021, now abandoned.

(60) Provisional application No. 63/194,734, filed on May 28, 2021, provisional application No. 63/182,194, filed on Apr. 30, 2021.

(51) Int. Cl.
*B65D 27/14* (2006.01)

(52) U.S. Cl.
CPC ..... *B65D 27/14* (2013.01)

(58) Field of Classification Search
CPC ..... B65D 31/10; B65D 27/14
See application file for complete search history.

(56) References Cited

U.S. PATENT DOCUMENTS 3,743,173 A 7/1973 Lasker
4,243,171 A * 1/1981 Prin ..... B65D 5/46088 229/110
4,913,561 A * 4/1990 Beer ..... B65D 31/10 383/94
D590,440 S 4/2009 Taute et al.
(Continued)

FOREIGN PATENT DOCUMENTS

DE 1976542 U 1/1968
EP 3597550 A1 1/2020

OTHER PUBLICATIONS

Ex Parte Quayle Action received for U.S. Appl. No. 29/786,154, mailed on Sep. 2, 2022, 7 pages.
(Continued)

*Primary Examiner* — Derek J Battisti
(74) *Attorney, Agent, or Firm* — Quarles & Brady LLP

(57) ABSTRACT

A foldable template for forming an envelope includes a central panel, a top glue flap, a bottom glue flap, a first intermediate panel, a second intermediate panel, a first back panel, and a second back panel. The first intermediate panel extends from a first side of the central panel and is separated therefrom by a first curved crease. The second intermediate panel extends from a second side of the central panel and is separated therefrom by a second curved crease. The first back panel extends from the first intermediate panel and is separated therefrom by a third curved crease. The second back panel extends from the second intermediate panel and is separated therefrom by a fourth curved crease.

24 Claims, 14 Drawing Sheets

(56) References Cited

U.S. PATENT DOCUMENTS

| | | | | |
|---|---|---|---|---|
| 8,182,152 | B2 * | 5/2012 | Plunkett | B32B 27/36 383/105 |
| D668,716 | S | 10/2012 | Bettinger | |
| 8,365,914 | B2 * | 2/2013 | Learn | B65D 5/0218 229/110 |
| D836,715 | S | 12/2018 | Wang et al. | |
| D898,583 | S | 10/2020 | Beardsall et al. | |
| D902,992 | S | 11/2020 | Wang et al. | |
| D929,497 | S * | 8/2021 | Harrilal | D19/3 |
| D949,966 | S | 4/2022 | Yan | |
| 2002/0141666 | A1 * | 10/2002 | Kuge | B65D 33/04 383/106 |
| 2003/0024950 | A1 * | 2/2003 | Yoneyama | B65D 77/062 222/105 |
| 2004/0129766 | A1 * | 7/2004 | Schropp | B65D 5/743 229/110 |
| 2009/0072015 | A1 * | 3/2009 | Drew | B65D 5/0209 229/102 |
| 2020/0207055 | A1 * | 7/2020 | Wirtz | B65B 3/04 |

OTHER PUBLICATIONS

International Search Report and Written Opinion received for PCT Patent Application No. PCT/US2022/026901, mailed on Jul. 28, 2022, 11 pages.

* cited by examiner

ENVELOPE AND TEMPLATE FOR FORMING SAME

CROSS-REFERENCE TO RELATED APPLICATIONS

The present application claims priority to and the benefit of U.S. Provisional Application No. 63/194,734, filed May 28, 2021, and entitled Envelope and Template for Forming Same, and U.S. Provisional Application No. 63/182,194, filed Apr. 30, 2021, and entitled Envelope and Template for Forming Same. The present application is also a continuation in part of U.S. patent application Ser. No. 29/816,638, filed Nov. 23, 2021, and entitled Corrugate Envelope, which is a continuation in part of U.S. patent application Ser. No. 29/786,154, filed May 28, 2021, and entitled Corrugate Envelope. The entire content of each of the foregoing patent application is incorporated herein by reference.

BACKGROUND

1. Technical Field

Exemplary embodiments of the disclosure relate to packaging. More specifically, embodiments of the disclosure relate to envelopes and templates for forming envelopes used to package one or more items.

2. The Relevant Technology

In many industries, packaging materials are used to deliver products to clients. Often such packaging materials take the form of envelopes which the products are placed in for transportation and delivery. While such envelopes may provide some protection to the items placed therein, there are drawbacks to the currently used envelopes. For instance, some current envelopes are formed primarily of paper materials that either do not provide sufficient protection for the items disposed therein or the envelopes are too stiff to allow for the packaging of items with a variety of sizes and shapes. Other currently used envelopes take the form of plastic bags or bubble mailers that incorporate plastic therein, which are non-sustainable and non-environmentally friendly. Additionally, plastic bag envelopes also provide minimal protection to the items disposed therein.

Accordingly, there remains room for improvement in packaging envelopes.

BRIEF SUMMARY

This disclosure relates to packaging. More specifically, the disclosure relates to envelopes and templates for forming envelopes used to package one or more items.

In one embodiment, a foldable template for forming an envelope includes a central panel, a top glue flap, a bottom glue flap, a first intermediate panel, a second intermediate panel, a first back panel, and a second back panel. The top glue flap extends from a first end of the central panel. The bottom glue flap extends from a second end of the central panel. The first intermediate panel extends from a first side of the central panel and is separated from the central panel by a first curved crease. The second intermediate panel extends from a second side of the central panel and is separated from the central panel by a second curved crease. The first back panel extends from the first intermediate panel and is separated from the first intermediate panel by a third curved crease. The second back panel extends from the second intermediate panel and is separated from the second intermediate panel by a fourth curved crease.

In another embodiments, a foldable template for forming an envelope includes a central panel, a top glue flap, a bottom glue flap, a first back panel, and a second back panel. The top glue flap extends from a first end of the central panel and the bottom glue flap extends from a second end of the central panel. The first back panel extends from a first side of the central panel and is separated from the central panel by one or more curved creases. The second back panel extends from a second side of the central panel and is separated from the central panel by one or more curved creases.

In yet another embodiment, a foldable template for forming an envelope includes a central panel, a first end, a second end, first and second intermediate panels, first and second back panels, one or more curved creases, and one or more creases. The first end is disposed at a first end of the central panel. The second end disposed at a second end of the central panel. The first and second intermediate panels extend respectively from first and second sides of the central panel. The first and second back panels extend respectively from the first and second intermediate panels. The one or more curved creases are disposed between the central panel and the first intermediate panel, between the central panel and the second intermediate panel, between the first intermediate panel and the first back panel, or between the second intermediate panel and the second back panel. The one or more creases are formed in one or more of the central panel, the first back panel, or the second back. The one or more creases extend from or near the one or more curved creases towards the first end of the template.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The embodiments described herein generally relate to packaging envelopes and templates for forming envelopes.

As used herein, the term "template" shall refer to a flat stock of material that can be folded into an envelope. In some embodiments, a template may also be referred to as a blank or an envelope blank. A template may have cuts, notches, cutouts, divides, and/or creases that allow the template to be bent and/or folded into an envelope. Additionally, a template may be made from any suitable material, generally known to those skilled in the art. For example, cardboard or corrugated paperboard may be used as the template material. Such template materials may have any suitable thickness and weight to permit the template to be bent and/or folded into an envelope. Additionally, as noted herein, the cardboard or corrugated paperboard used as the template material may include single face or single wall corrugate material.

As used herein, the term "crease" shall refer to a line along which any portion of the template may be folded. For example, a crease may be an indentation in the template material, which may facilitate the folding of a portion of the template that is adjacent to the crease. A suitable indentation may be created by applying sufficient and/or varying pressures to reduce the thickness of the material in the desired location and/or by removing some of the material along the desired location, such as by scoring.

While the present disclosure will be described in detail with reference to specific configurations, the descriptions are illustrative and are not to be construed as limiting the disclosure. Various modifications can be made to the illustrated configurations without departing from the spirit and scope of the invention as defined by the claims. For better understanding, like components have been designated by like reference numbers throughout the various accompanying figures.

In some instances, creases are illustrated in the figures with broken, dashed, or dahs-dot-dash lines. Additionally, references to the "top", "bottom", or "sides" of the envelopes or templates are arbitrary and made for descriptive purposes only. Similarly, the terms "length," "width," and "height" are chosen arbitrarily. Thus, a described "length" may be considered a width or a height, a described "width" may be considered a length or a height, and a described "height" may be considered a length or a width. Such designations are not intended to represent or connote any specific orientation or location of the envelope template, its components, or an envelope formed therewith.

Figure 1:
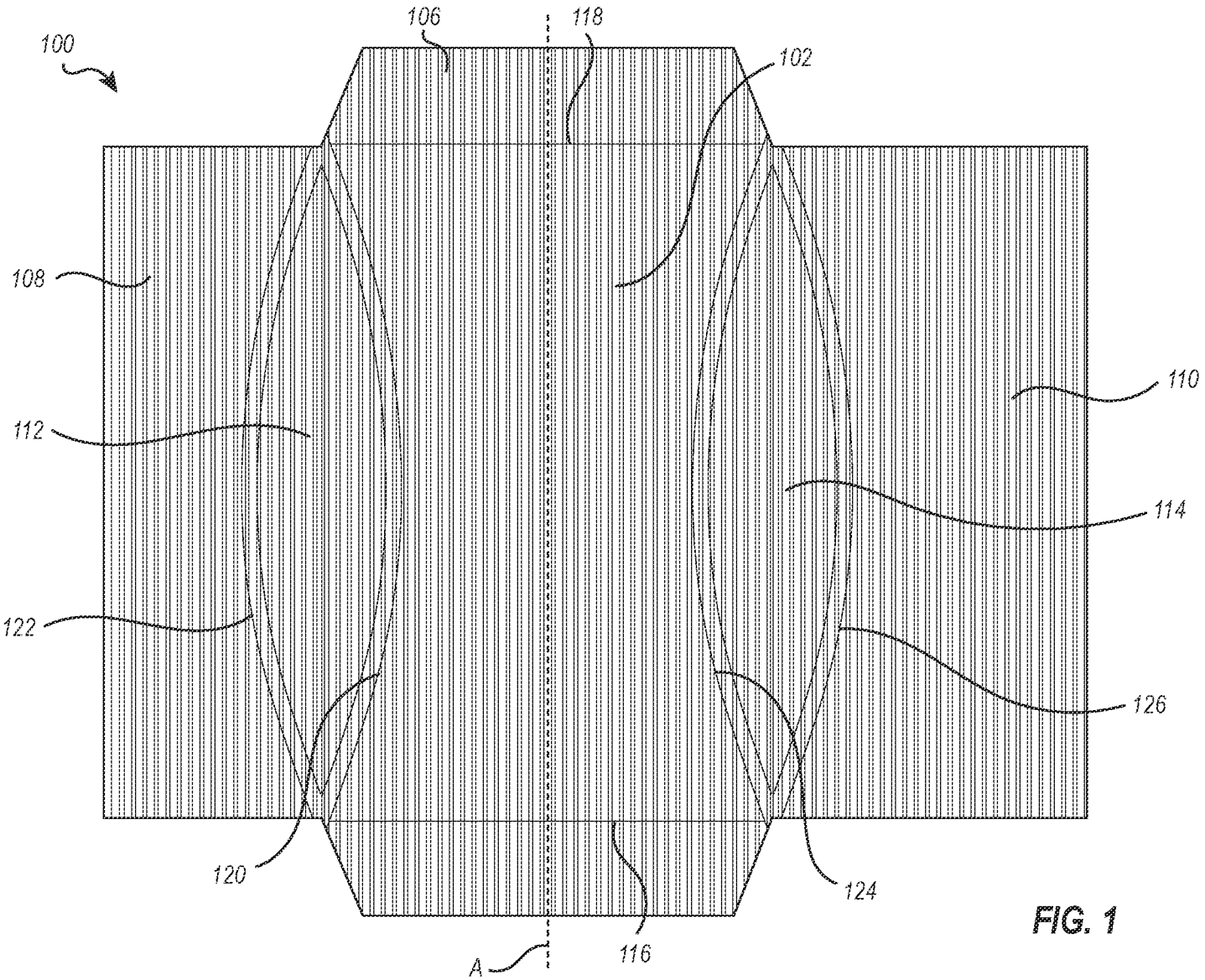
FIG. 1 illustrates a plan view of a first side of a foldable envelope template according to an exemplary embodiment of the present disclosure.

FIG. 1 illustrates an exemplary embodiment of a foldable envelope template 100. The face or surface of the template 100 shown in FIG. 1 may form an interior surface of an envelope formed with the template 100. The template 100 may have a substantially rectangular shape with four corner areas cut out. In the illustrated embodiment, the template 100 has a central panel or section 102, a bottom glue flap 104, a top glue flap 106, a left panel or section 108, and a right panel or section 110. Disposed between the central panel 102 and the left panel 108 is an intermediate panel or section 112. Similarly, disposed between the central panel 102 and the right panel 110 is an intermediate panel or section 114.

The central panel 102 may also be referred to as a front panel as it may form a front surface or panel of an envelope formed with the template 100. Similarly, the left panel 108 and the right panel 110 may also be referred to as back panels as they may collectively form a back surface or panel of an envelope formed with the template 100.

In the illustrated embodiment, the bottom glue flap 104 extends from an end of the central panel 102. The central panel 102 and the bottom glue flap 104 are defined or distinguished from one another by a crease 116. The top glue flap 106 extends from an end of the central panel 102 opposite to the end from which the bottom glue flap 104 extends. The central panel 102 and the top glue flap 106 are defined or distinguished from one another by a crease 118. The shapes of the bottom glue flap 104 and the top glue flap 106 may vary from one embodiment to another. For instance, as shown in the Figures, the bottom glue flap 104 and the top glue flap 106 may each be generally rectangular in shape. In other embodiments, one or both of the bottom glue flap 104 and the top glue flap 106 have different shapes, contours, or features. By way of example, the corners of one or both of the bottom glue flap 104 and the top glue flap 106 may have right angles, non-right angles, curves, etc.

In the illustrated embodiment, the intermediate panel 112 extends from a side of the central panel 102. The central panel 102 and the intermediate panel 112 are defined or distinguished from one another by a crease 120. In the illustrated embodiment, the crease 120 extends between first ends of the creases 116, 118. As also illustrated in FIG. 1, the crease 120 has a curved configuration. The crease 120 is curved inwards towards the center of the central panel 102, such that an apex of the curved crease 120 is positioned closer to a central axis A (that extends through the central panel 102) than the ends of the curved crease 120.

The side of the intermediate panel 112 opposite the crease 120 is also defined by a crease 122. The crease 122 defines a border between or distinguishes the intermediate panel 112 and the left panel 108. The left panel 108 extends from the intermediate panel 112 from a side of the intermediate panel 112 opposite to the central panel 102. Similar to the crease 120, the crease 122 extends between the ends of the creases 116, 118. The crease 122 also has a curved configuration. The crease 122 is curved away from the central panel 102 and towards the center of the left panel 108 (e.g., an apex of the curved crease 122 is positioned further away from the central panel 102 than the ends of the curved crease 122).

As can be seen in FIG. 1, the creases 120, 122 are curved in opposite directions and define the intermediate panel 112. In the illustrated embodiment, the curves of the creases 120, 122 give the intermediate panel 112 a generally lenticular shape. It will be appreciated that the creases 120, 122 may have different configurations, which results in the intermediate panel 112 having a different shape. For instance, the creases 120, 122 may have curved portions, straight portions, or combinations thereof. Accordingly, as used herein, a "curved crease" may be a crease that has a curved or non-linear configuration. For instance, a "curved crease" may include any shape or configuration that does not extend in only a single straight line or direction. A "curved crease" may also include a crease that has an offset between opposing ends thereof and a portion between the opposing ends, as described herein.

As a result, the intermediate panel 112 may have an oval, airfoil, tear-drop, or rhombus shape. In some embodiments, the creases 120, 122 may extend only partially between the creases 116, 118. As a result, the intermediate panel 112 may have a shape that is a partial lenticular, oval, airfoil, tear-drop, or rhombus shape. It will be appreciated, that "partial" as used herein can also include a quarter, three-quarter, or other portion of a complete shape or configuration.

In the illustrated embodiment, the intermediate panel 114 extends from a side of the central panel 102 opposite to the intermediate panel 112. The central panel 102 and the intermediate panel 114 are defined or distinguished from one another by a crease 124. In the illustrated embodiment, the crease 124 extends between the opposite or second ends of the creases 116, 118 from which the creases 120, 122 extend. As also illustrated in FIG. 1, the crease 124 has a curved configuration. The crease 124 is curved inwards towards the center of the central panel 102, such that an apex of the curved crease 124 is positioned closer to the axis A than ends of the crease 124. The creases 120, 124 curve towards one another such that midway points thereof are positioned closer together than ends thereof.

The side of the intermediate panel 114 opposite the crease 124 is also defined by a crease 126. The crease 126 defines a border between or distinguishes the intermediate panel 114 and the right panel 110. The right panel 110 extends from the intermediate panel 114 from a side of the intermediate panel 114 opposite to the central panel 102. Similar to the crease 124, the crease 126 extends between the second ends of the creases 116, 118. The crease 126 also has a curved configuration. The crease 126 is curved away from the central panel 102 and towards the center of the right panel 110 (e.g., an apex of the curved crease 126 is positioned further from the central panel 102 than the ends of the crease 126).

As can be seen in FIG. 1, the creases 124, 126 are curved in opposite directions and define the intermediate panel 114. In the illustrated embodiment, the curves of the creases 124, 126 give the intermediate panel 114 a generally lenticular shape. It will be appreciated that the creases 124, 126 may have different configurations, which result in the intermediate panel 114 having a different shape. For instance, the creases 124, 126 may have curved portions, straight portions, or combinations thereof. As a result, the intermediate panel 114 may have an oval, airfoil, tear-drop, or rhombus shape. In some embodiments, the creases 124, 126 may extend only partially between the creases 116, 118. As a result, the intermediate panel 114 may have a shape that is a partial lenticular, oval, airfoil, tear-drop, or rhombus shape.

While the template 100 is described as having four creases 120, 122, 124, 126, it will be appreciated that that is merely exemplary. In other embodiments, the creases 120, 122 may be formed as a continuous crease and the creases 124, 126 may be formed as a continuous crease. In other embodiments, one or more of the creases 120, 122, 124, 126 may be formed of smaller creases.

Figure 2:
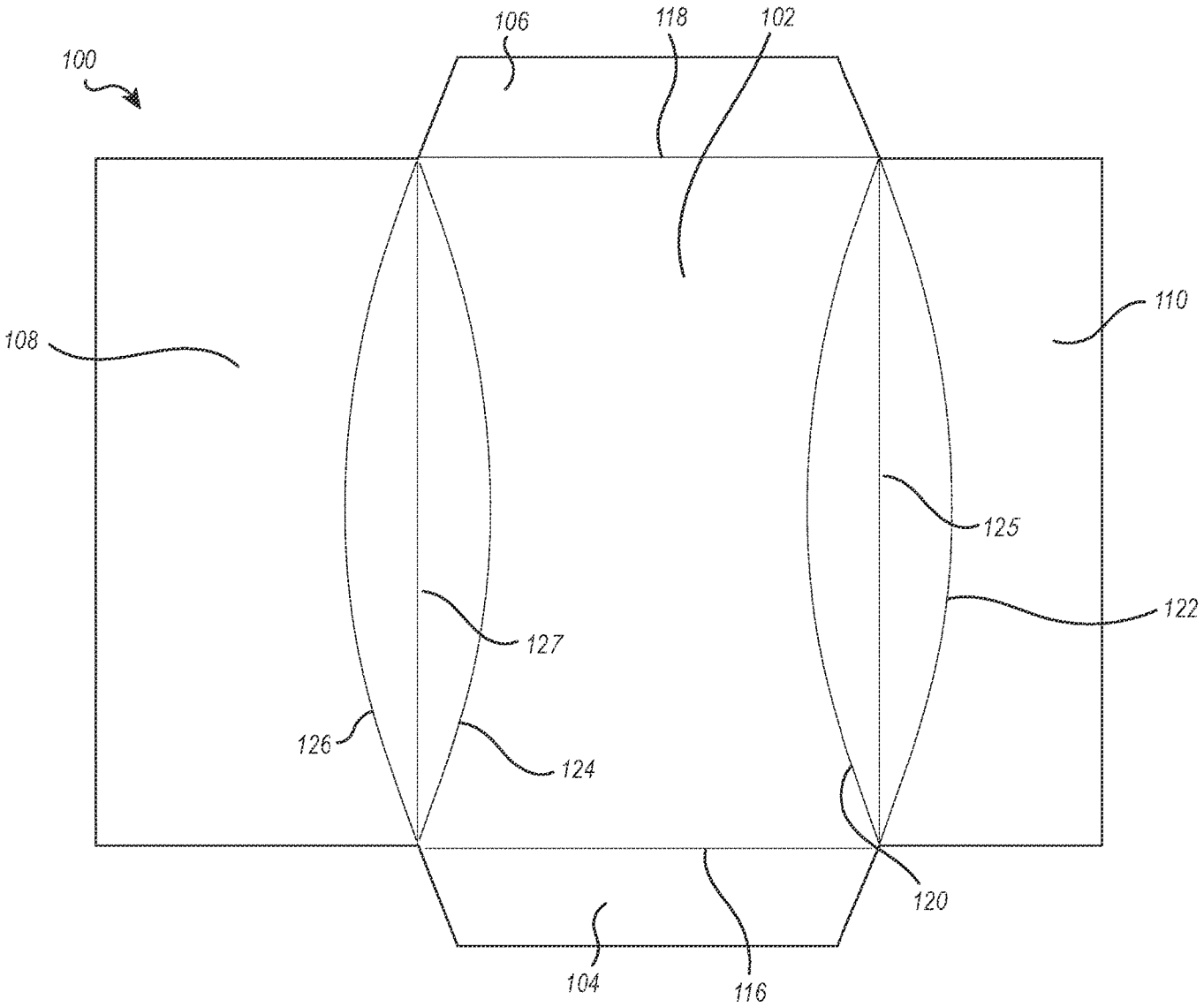
FIG. 2 illustrates a plan view of a second side of the foldable envelope template of FIG. 1.
Figure 3A:
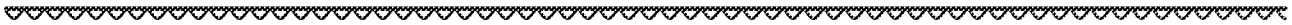
FIGS. 3A-3D illustrate end and side perspective views of the foldable envelope template of FIGS. 1 and 2.
Figure 3B:
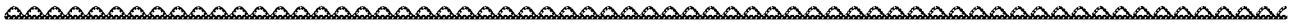
Figure 3C:
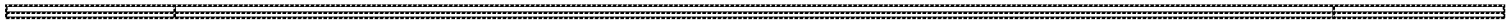
Figure 3D:
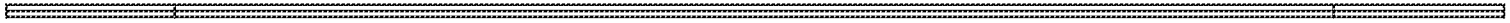

FIG. 2 illustrates a second face or surface of the template 100 that may form an exterior surface of an envelope formed with the template 100. In FIG. 2, the creases 116, 118 between the central panel 102 and the bottom and top glue flaps 104, 106 are faintly visible. In some embodiments, visibility of the creases 116, 118 may be more prominent. In still other embodiments, the creases 116, 118 may not be visible on the illustrated (outer) surface of the template 100. Similarly, the creases 120, 122, 124, 126 may not be visible, may be faintly visible, or may be prominently visible on the outer surface of the template 100.

In the illustrated embodiment, the template 100 is formed of a single faced corrugate material. Single faced corrugate material has a flat or smooth liner layer as shown in FIG. 2. Attached to a surface of the liner layer is a fluted layer as shown in FIG. 1. The single faced corrugate material may be A, E, B, or C flute material, as well as standard single wall corrugate that is comprised of two liners with fluting in between, which material may be of varying strengths, as known in the art. According to the illustrated embodiment, the fluted layer will form an interior surface of an envelope formed with the template 100 and the liner layer will form an exterior surface of the envelope.

As can be seen in FIG. 2, the template 100 may optionally include creases 125, 127. The crease 125 extends through intermediate panel 112. The creases 125, 127 extend partially or entirely between ends of the creases 116, 116. The crease 125 divides the intermediate panel 112 into two portions. A first portion of the intermediate panel 114 is disposed between the crease 125 and the curved crease 120 and will form a portion of a front of an envelope formed with the template 100. A second portion of the intermediate panel 114 is disposed between the crease 125 and the curved crease 122 and will form a portion of a rear or back of an envelope formed with the template 100. Similarly, the crease 127 can be disposed between the curved creases 124, 126 and can divide the intermediate panel 114 into two portions that will form parts of a front and a rear of an envelope formed with the template 100. The creases 125, 127 may facilitate folding of the template 100 into an envelope.

FIGS. 3A-3D illustrate side and end perspective views of the template 100.

Figure 4:
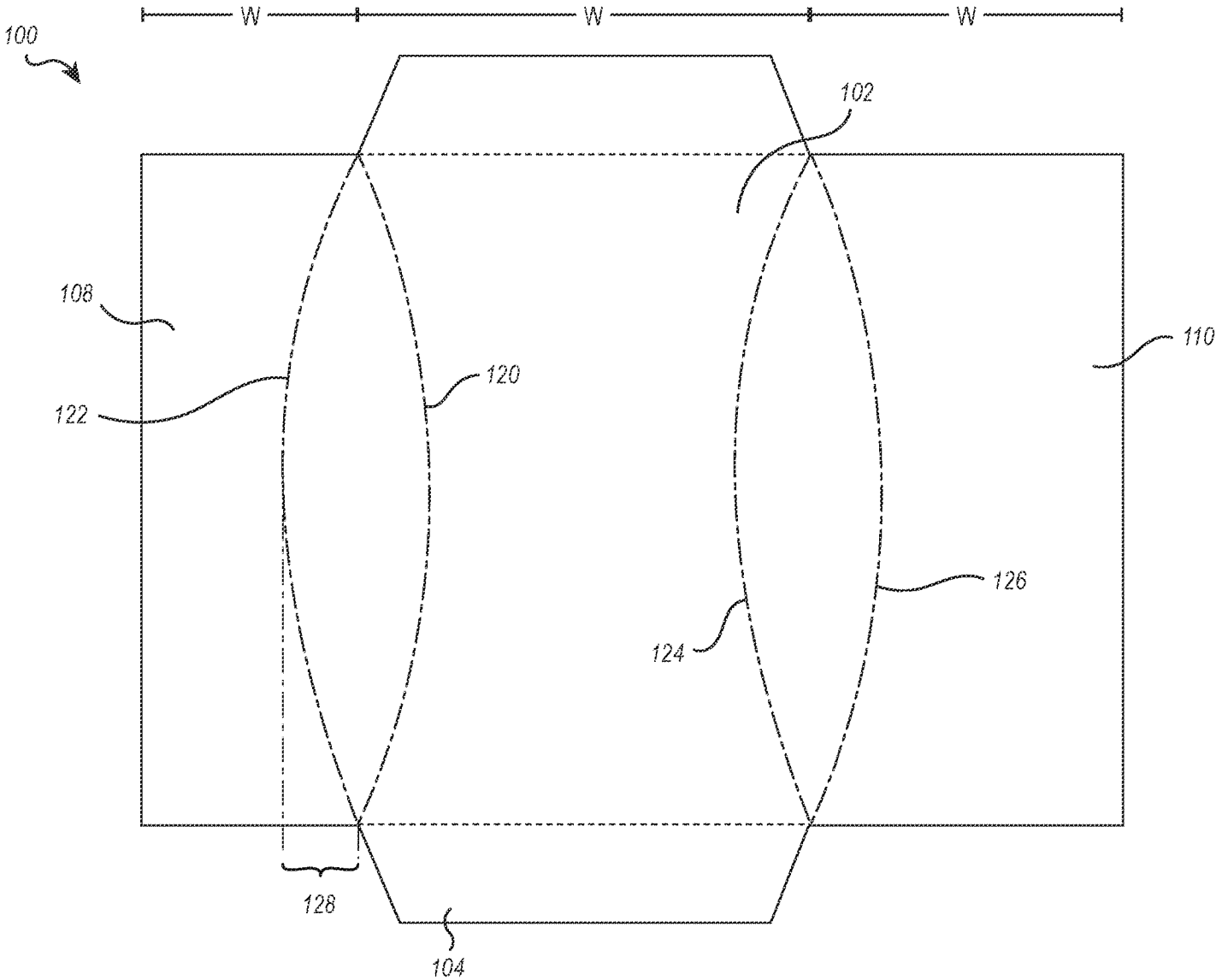
FIG. 4 illustrates a schematic plan view of the foldable envelope template of FIG. 1.

FIG. 4 illustrates a schematic view of the template 100. As can be seen, the crease 122 has a curvature such that a central portion or apex of the crease 122 has an offset 128 from the opposing ends of the crease 122. In some embodiments, the offset 128 is about 0.5 inches, about 1 inch, about 1.5 inches, about 2 inches, about 2.5 inches, about 3 inches, or any dimension less than the noted dimensions, greater than the noted dimensions, or between the noted dimensions. In some embodiments, the creases 120, 124, 126 may have similarly dimensioned offsets as crease 122. In other embodiments, some of the creases 120, 122, 124, 126 may have the same or similar offsets while others have different offsets.

In the illustrated embodiment, the creases 120, 126 are offset in the same direction and the creases 122, 124 are offset in the same direction. The offsets of the creases 120, 126 and the creases 122, 124 are in opposite directions. The particular dimension of the offset 128 may be determined by one or more dimensions of the template 100 and/or one or more dimensions of the envelope formed from the template 100.

As can be seen in FIG. 4, each of the left and right panels 108, 110 has a width W that extends in a direction away from the central panel 102. In the illustrated embodiment, the width of the right panel 110 is greater than the width of the left panel 108. In other embodiments, the left panel 108 may have a width that is greater than the right panel 110. In still other embodiments, the left and right panels 108, 110 may have widths that are equal to one another.

In some embodiments, the combined widths of the left and right panels 108, 110 are greater than the width W of the central panel 102. As a result, when the template 100 is folded to form an envelope (as discussed below), the left and right panels 108, 110 can overlap one another and be attached together. In other embodiments, the combined widths of the left and right panels 108, 110 may be equal to the width of the central panel 102 such that the edges of the left and right panels 108, 110 abut one another when folded to form an envelope.

Figure 5:
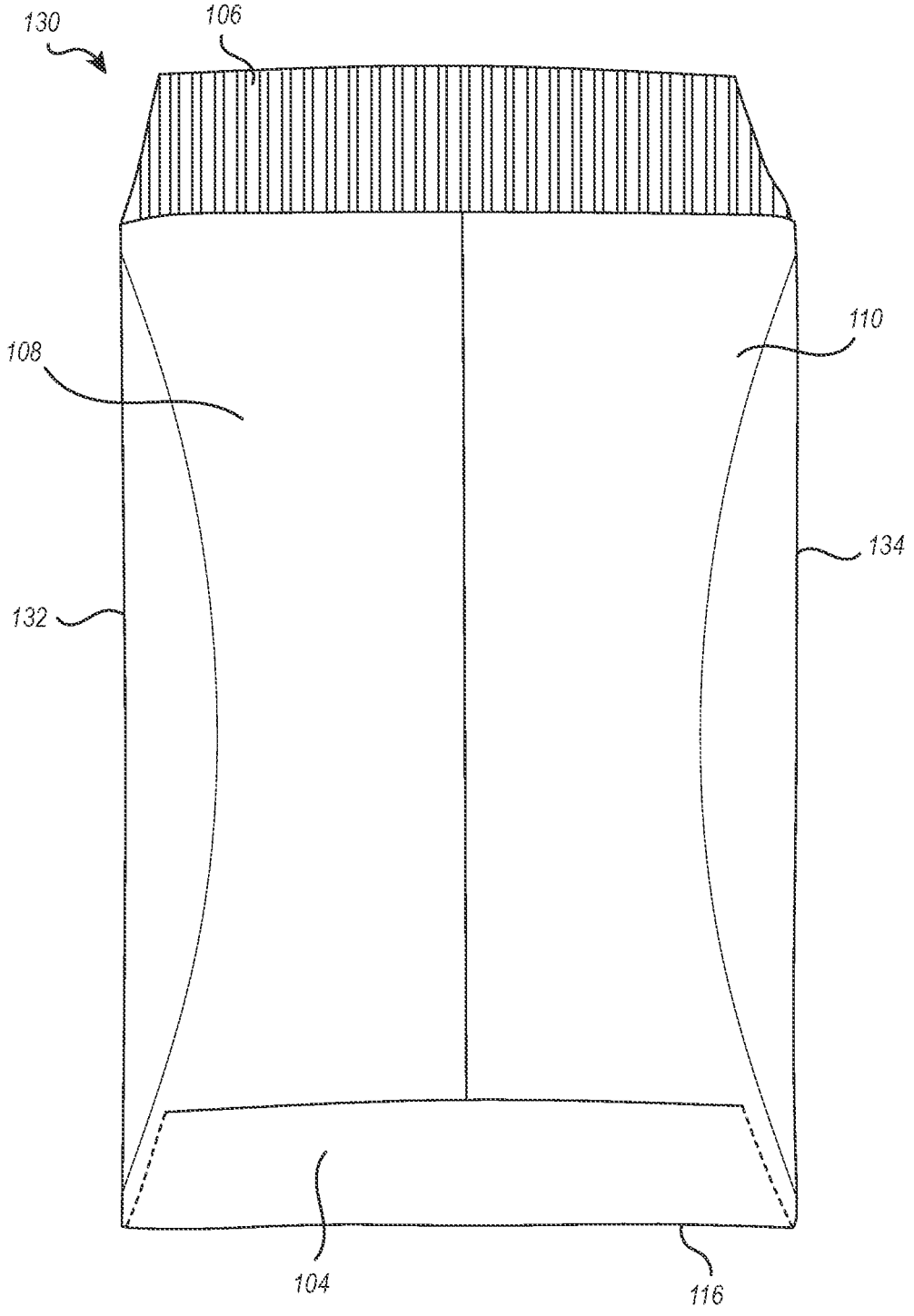
FIGS. 5-10 illustrate various views of an envelope formed from the foldable envelope template of FIG. 1.

Attention is now directed to FIGS. 5-10, which illustrate various views of an envelope 130 formed from the template 100. FIG. 5 illustrates a back view of the envelope 130. As can be seen, a fold 132 has been made in the template 100 to fold the left panel 108 onto the central panel 102. Similarly, a fold 134 has been made in the template 100 to fold the right panel 110 onto the central panel 102. In the illustrated embodiment, when the left and right panels 108, 110 are so folded, they overlap and can be glued or otherwise attached together along all or a portion of their lengths.

In the illustrated embodiment, the folds 132, 134 extend along the length of the envelope 130. While the creases 120, 122, 124, 126 are not visible in FIG. 5, the folds 132, 134 extend through the center of the intermediate panels 112, 114 and between the creases 120, 122, 124, 126. The folds 132, 134 may be formed in the template 100 prior to folding the template 100 into the envelope 130 (e.g., when the creases 120, 122, 124, 126 are being formed in the template 100). Alternatively, the folds 132, 134 may be manually formed in the template 100 during the process of converting the template 100 into the envelope 130.

As also illustrated in FIG. 5, the bottom glue flap 104 has been folded along crease 116 and onto the left and right panels 108, 110. The bottom glue flaps 104 can be glued or otherwise attached to the left and right panels 108, 110 along all or a portion of the widths thereof. As shown in FIG. 5, the top glue flap 106 remains unfolded. Once the envelope 130 is filled with the desired contents, the top glue flap 106 can be folded along crease 118 and secured to the left and right panels 108, 110.

While the bottom glue flap 104 is illustrated as being attached to an outer surface of the left and right panels 108, 110, it will be appreciated that the bottom glue flap 104 may be attached to an interior surface thereof. For instance, prior to folding the left and right panels 108, 110 along folds 132, 134, the bottom glue flap 104 may be folded and then the left and right panels 108, 110 may be folded on top of the bottom glue flap 104.

Figure 6:
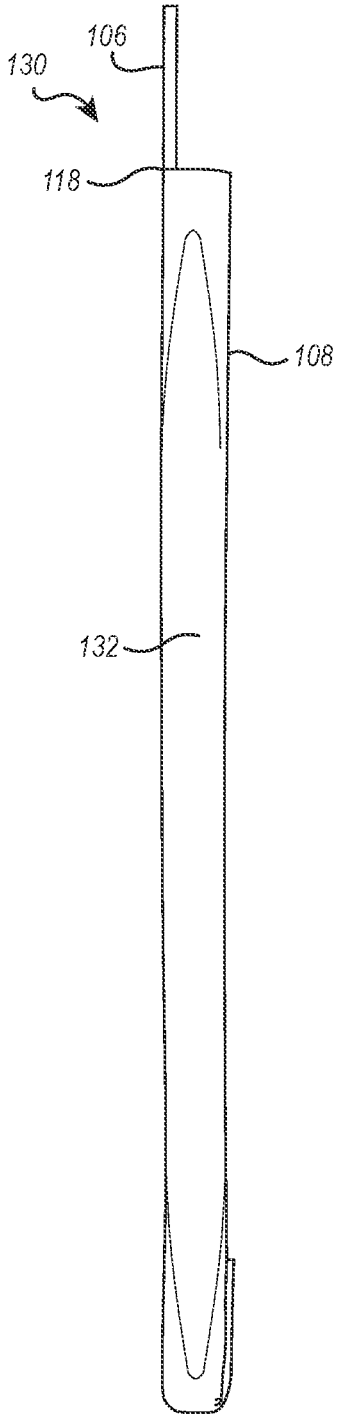
Figure 7:
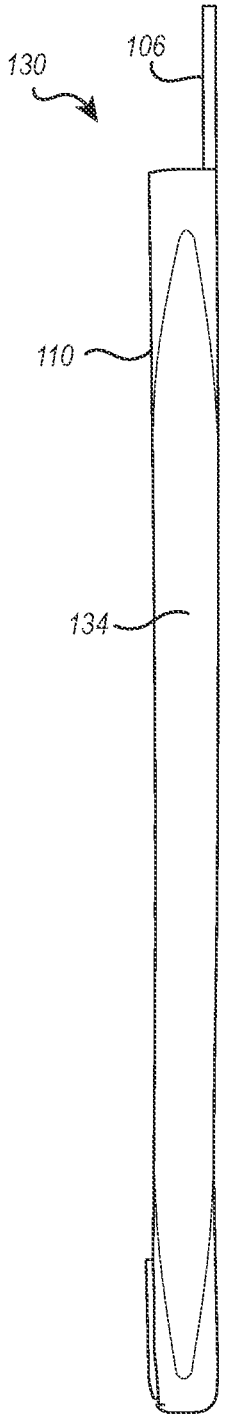
Figure 8:
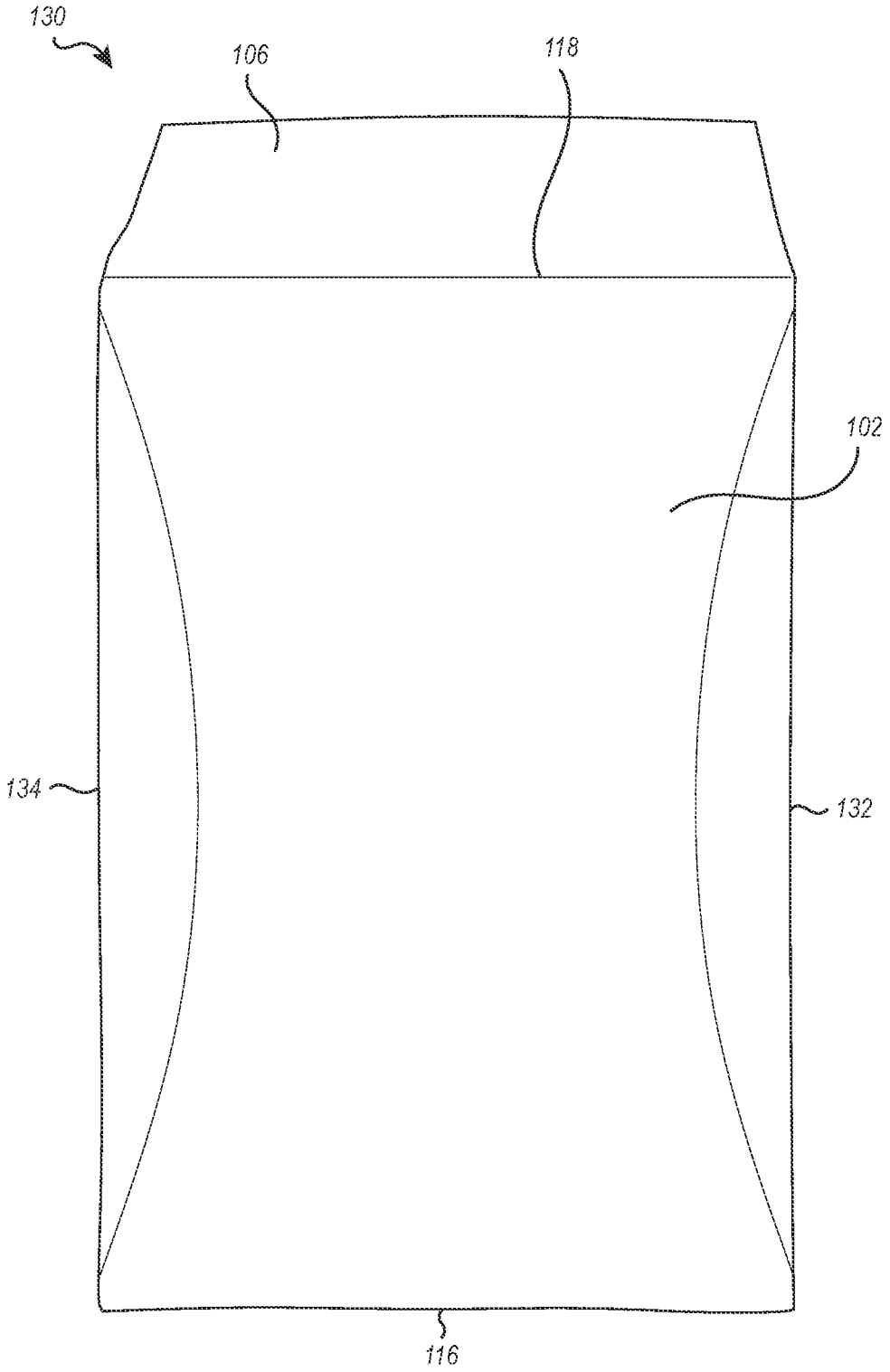
Figure 9:
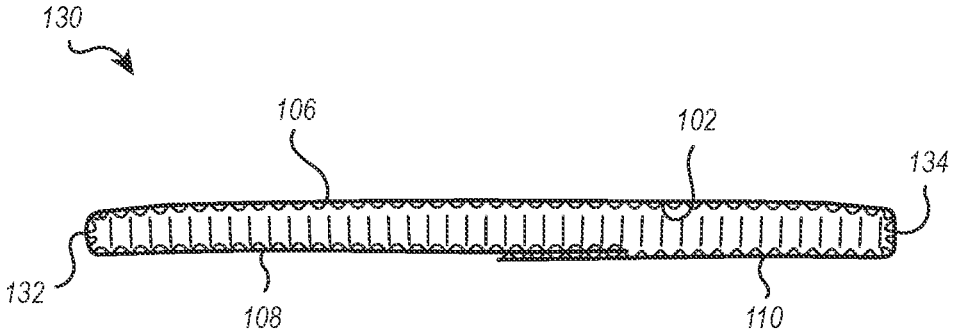
Figure 10:
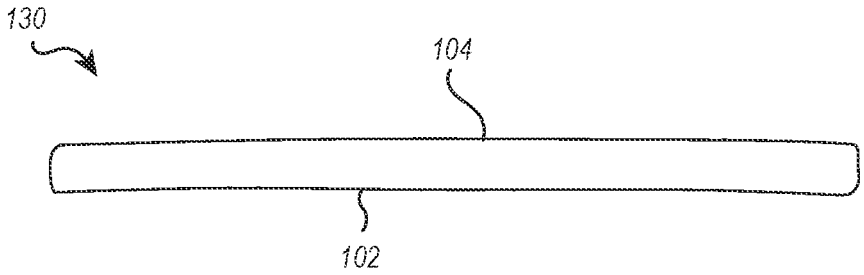

FIGS. 6 and 7 illustrate left and right views of the envelope 130, FIG. 8 illustrates a front view of the envelope 130, FIG. 9 illustrates a top view of the open envelope 130, and FIG. 10 illustrates a bottom view of the envelope 130.

Figure 11:
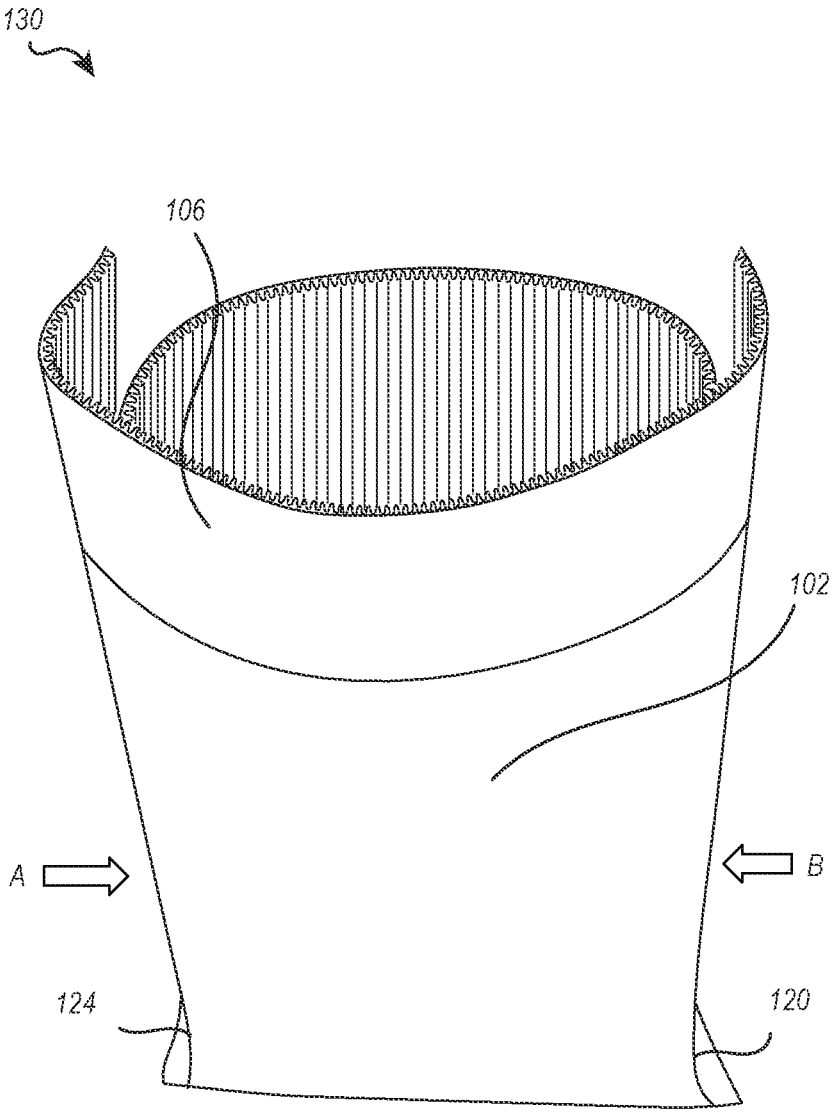
FIGS. 11 and 12 illustrate the envelope of FIG. 10 in an expanded configuration.
Figure 12:
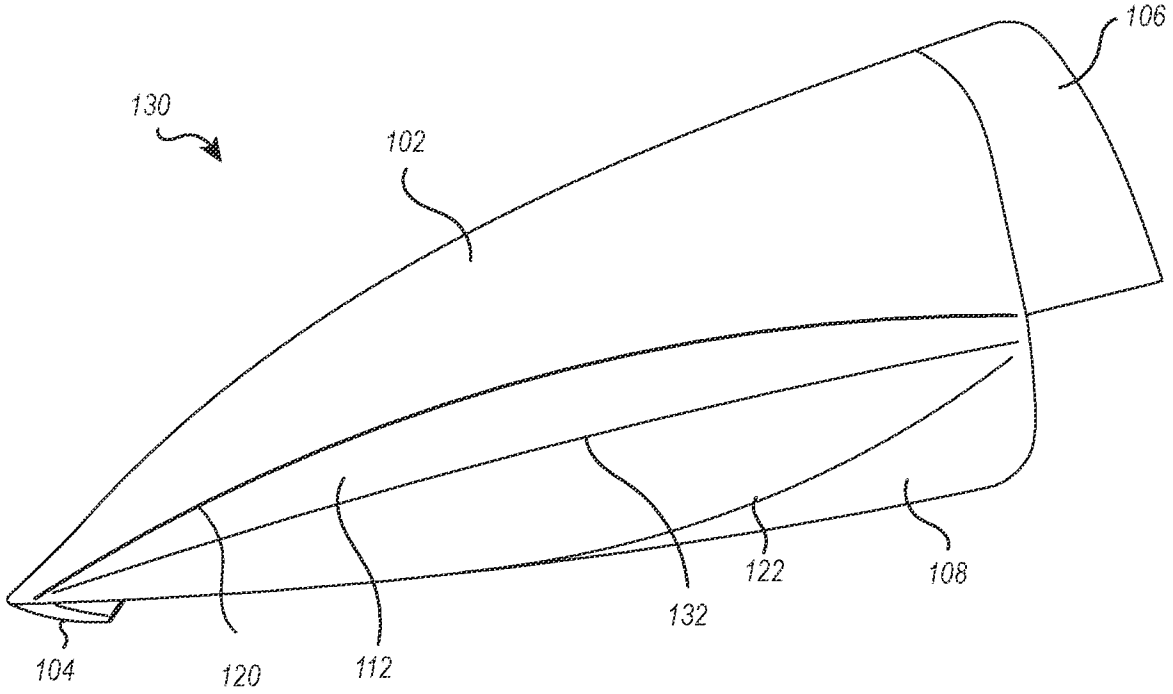

Once the envelope 130 is formed as shown in FIGS. 5-10, the envelope 130 can be expanded or opened in preparation for having items placed therein. For instance, as shown in FIGS. 11 and 12, opposing pressures can be applied to the sides of the envelope 130 (e.g., along folds 132, 134, within intermediate panels 112, 114) in the directions of arrows A, B. As the pressures are applied to the envelope 130, the width of the envelope 130 in the area where the pressures are applied decreases and the height of the envelope 130 increases. The height of the envelope 130 can be defined as the distance between the central panel 102 and a rear panel (formed by the left and right panels 108, 110) of the envelope 130.

When the pressures are applied to the sides of the envelope 130, the envelope 130 can fold or bend along portions or the entire lengths of creases 120, 122, 124, 126. When the envelope 130 is folded or bent along the creases 120, 122, 124, 126, the envelope 130 may be in an open or expanded configuration as shown in FIGS. 11 and 12. Due to the envelope being folded along the creases 120, 122, 124, 126, the envelope 130 may maintain the open or expanded configuration without continuous pressure being applied to the sides thereof.

With the envelope 130 in the open or expanded configuration, items may be inserted into the open top end of the envelope 130. Optionally, once the items are inserted into the envelope 130, the creases 120, 122, 124, 126 may be at least partially unfolded or flattened. The top end of the envelope 130 may then be closed. For instance, the top glue flap 106 may be folded along crease 118 and onto the left and right panels 108, 110 and attached thereto.

The envelope template 100 may include features to facilitate the ready opening of the envelope 130. For instance, one or both of the bottom and top glue flaps 104, 106 may include a tear-away strip. The tear-away strip may include perforations, cuts, notches, scores, or cutouts extending along all or a portion of the width of the glue flap. Furthermore, the tear-away strip may also or alternatively include a strip of plastic or other durable material secured to a surface thereof.

In any configuration, the tear-away strip may facilitate the separation of the glue flap into two pieces along the width thereof (e.g., by tearing along the perforations or tearing through the glue flap with the aid of the plastic strip). Once the glue flap is separated into two pieces, the portion of the glue flap that is still connected to the central panel 102 can be unfolded and the envelope 130 opened.

In some embodiments, the envelope 130 may be resealed even after the glue flap is separated into two pieces. For instance, the portion of the glue flap that is still connected to the central panel 102 may include a glue strip that can be used to reattach the glue flap to the left and right panels 108, 110. Prior to use, the glue strip may be covered with a material to prevent premature attachment of the glue flap to another surface.

Figure 13:
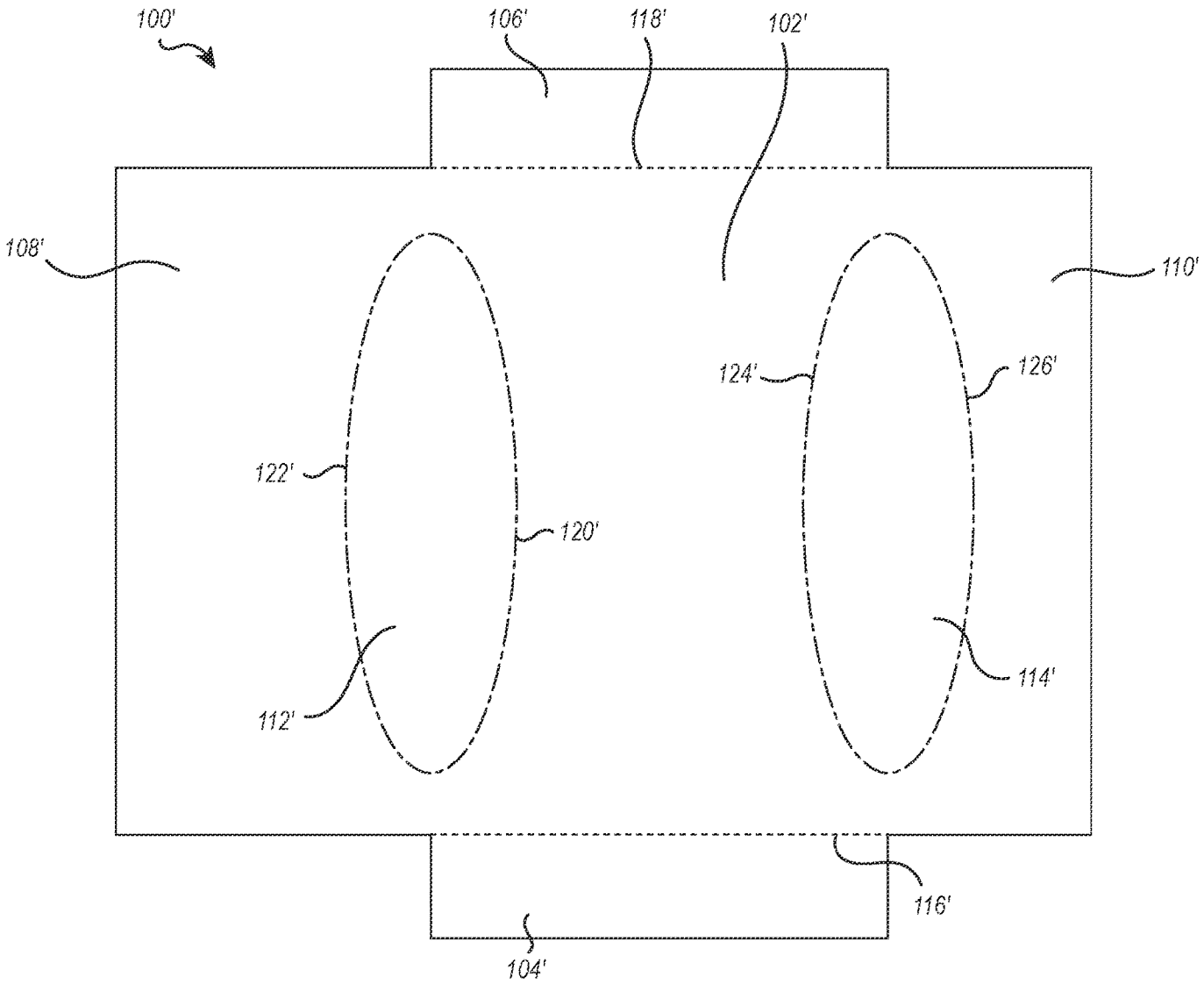
FIG. 13 illustrates a schematic view of another example embodiment of a foldable envelope template according to the present disclosure.

Attention is now directed to FIG. 13, which illustrates another example embodiment of an envelope template 100'. In some respects, the template 100' may be similar or identical to the template 100. However, the template 100' may include features that are distinct from those of the template 100. For instance, the creases 120', 122', 124', 126' do not extend all the way between the ends of the creases 116', 118'.

Rather, the ends of the creases 120', 122', 124', 126' may be spaced apart from the ends of the creases 116', 118' by about 0.5 inches, about 1 inch, about 1.5 inches, about 2 inches, about 2.5 inches, about 3 inches, or any dimension great then, less than, or between the noted dimensions. The spacing between the creases 120', 122', 124', 126' and the ends of the creases 116', 118' may vary depending on one or more dimensions of the template 100' and/or one or more dimensions of the envelope formed therefrom. Furthermore, the offset of the creases 120', 122', 124', 126' may be similar or identical to the offset 128 described in connection with the embodiment of FIG. 4.

While the template 100' is described as having four creases 120', 122', 124', 126', it will be appreciated that that is merely exemplary. In other embodiments, the creases 120', 122' may be formed as a continuous crease and the creases 124', 126' may be formed as a continuous crease. In other embodiments, one or more of the creases 120', 122', 124', 126' may be formed of smaller creases.

Figure 14:
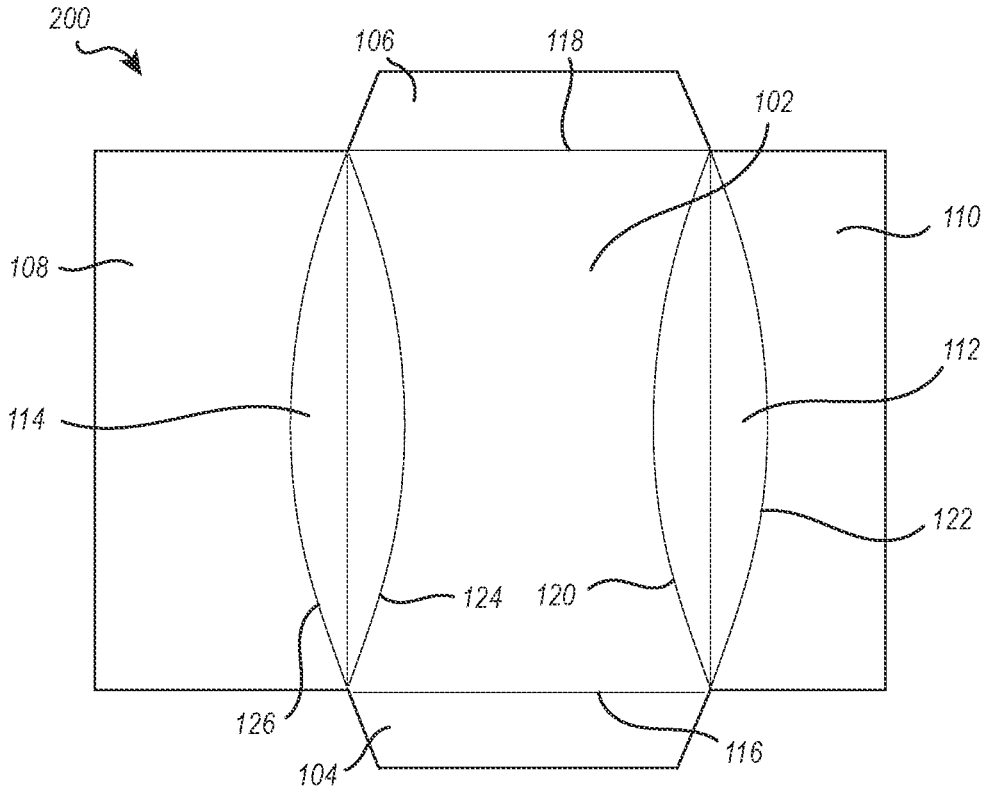
FIGS. 14-15 illustrate plan views of opposing sides of a foldable envelope template according to an exemplary embodiment of the present disclosure.
Figure 15:
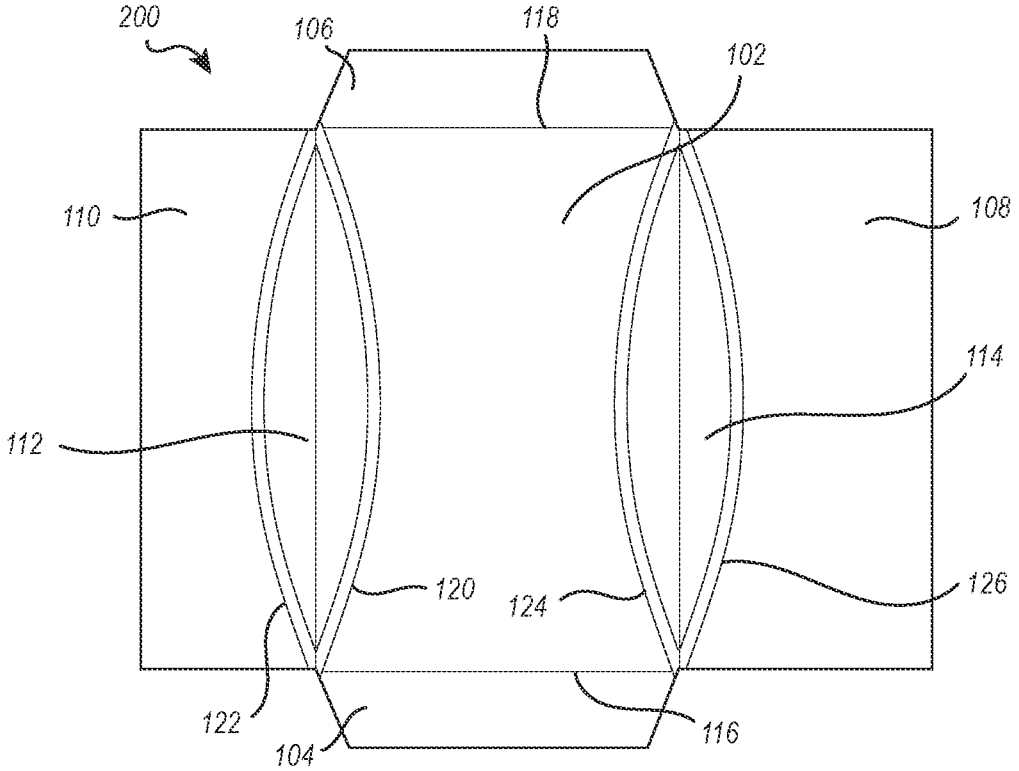

Attention is now directed to FIGS. 14 and 15, which illustrate an envelope template 200. More specifically, FIGS. 14 and 15 illustrate plan views of opposing sides of the template 200. The template 200 is substantially similar to the template 100. Accordingly, the description of the template 100 is equally applicable to the template 200.

However, one distinction between the templates 100 and 200 is that the template 200 is formed of single wall corrugate, whereas the template 100 is formed of single face corrugate. As noted above, single face corrugate has a smooth liner layer and a fluted layer attached thereto. In contrast, single wall corrugate, as used in the template 200, has two liner layers with a fluted layer disposed therebetween.

Depending on the desired structural characteristics of an envelope, single face or single wall corrugate may be used to form the template and the envelope. For instance, if the envelope needs to be more rigid or provide greater protection to its contents, single wall corrugate may be used to form the template and resulting envelope.

Figure 16:
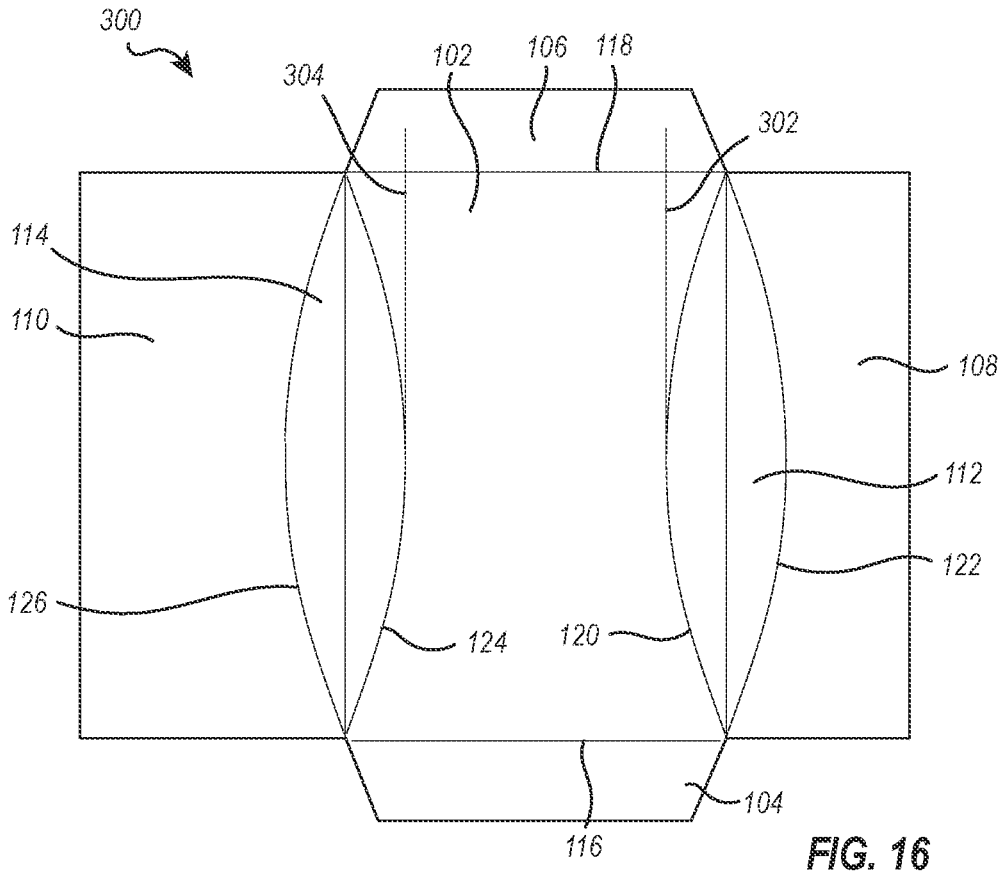
FIGS. 16-17 illustrate plan views of opposing sides of a foldable envelope template according to an exemplary embodiment of the present disclosure.
Figure 17:
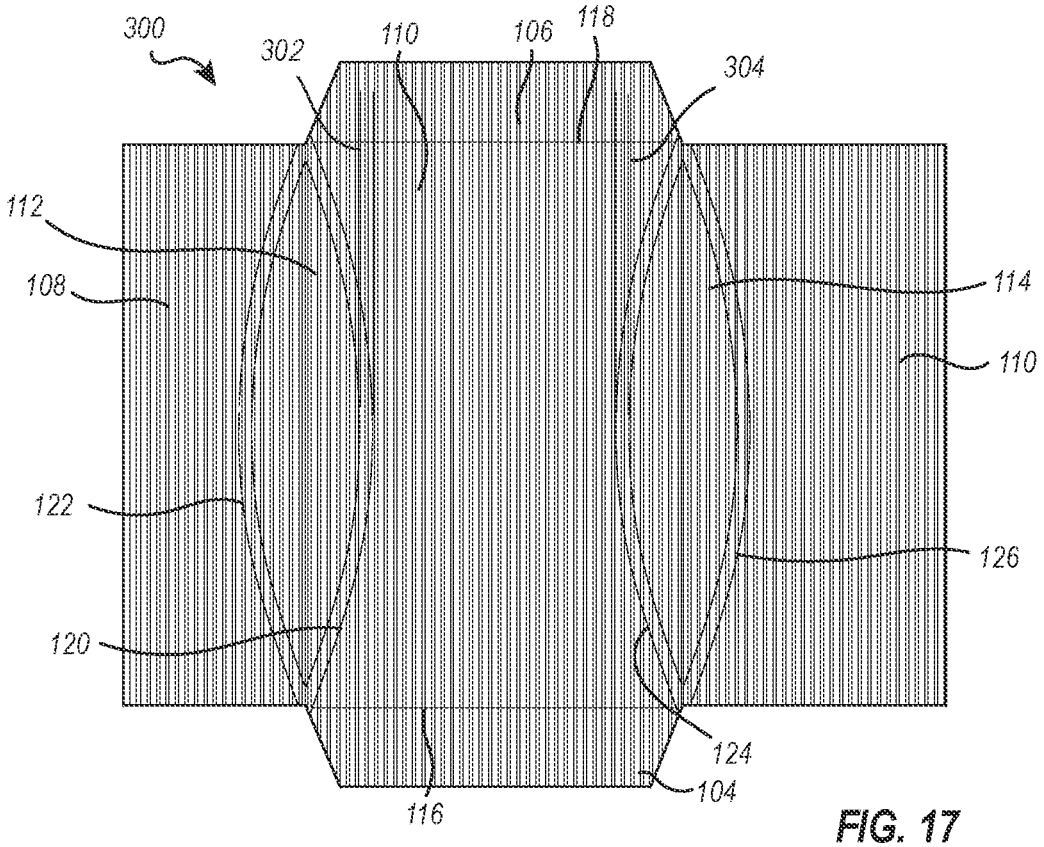

Attention is now directed to FIGS. 16 and 17, which illustrate an envelope template 300. More specifically, FIGS. 14 and 15 illustrate plan views of opposing sides of the template 300. The template 300 is substantially similar to the template 100. Accordingly, the description of the template 100 is equally applicable to the template 300.

However, one distinction between the templates 100 and 300 is that the template 300 includes creases 302, 304 formed in the central panel 102. In the illustrated embodiment, crease 302 extends from or near the apex of crease 120 and towards the glue flap 106. Similarly, the crease 304 extends from or near the apex of crease 124 and towards the glue flap 106. In other embodiments, the creases 302, 304 may extend from other portions of or near the creases 120, 124 (e.g., midway between the apex and ends thereof).

In some embodiments, one or both of the creases 302, 304 extend partially or entirely to the crease 118 between the central panel 102 and the glue flap 106. In other embodiments, one or both of the creases 302, 304 extend partially or entirely through the glue flap 106.

The creases 302, 304 can facilitate placing the envelope formed with the template 300 in an open or expanded configuration, similar to that shown in FIGS. 11 and 12. However, the creases 302, 304 enable the envelope to fold therealong, which can allow for the open end of the envelope to open even further and/or hold itself open while the envelope is being filled.

Figure 18:
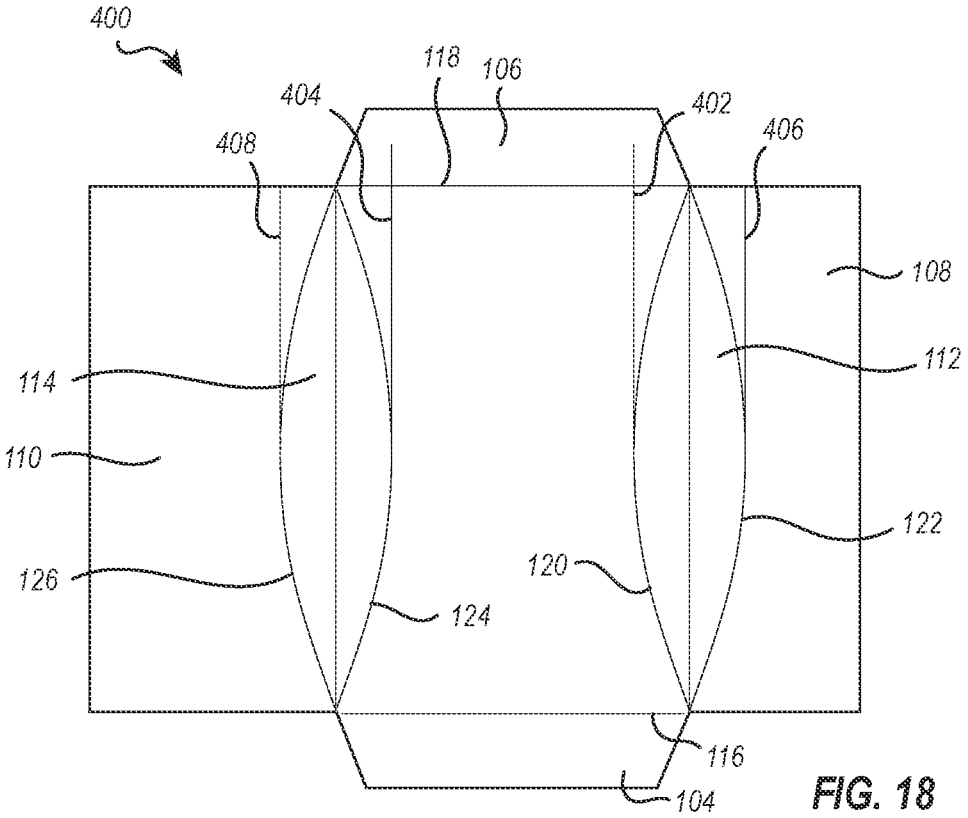
FIGS. 18-19 illustrate plan views of opposing sides of a foldable envelope template according to an exemplary embodiment of the present disclosure.
Figure 19:
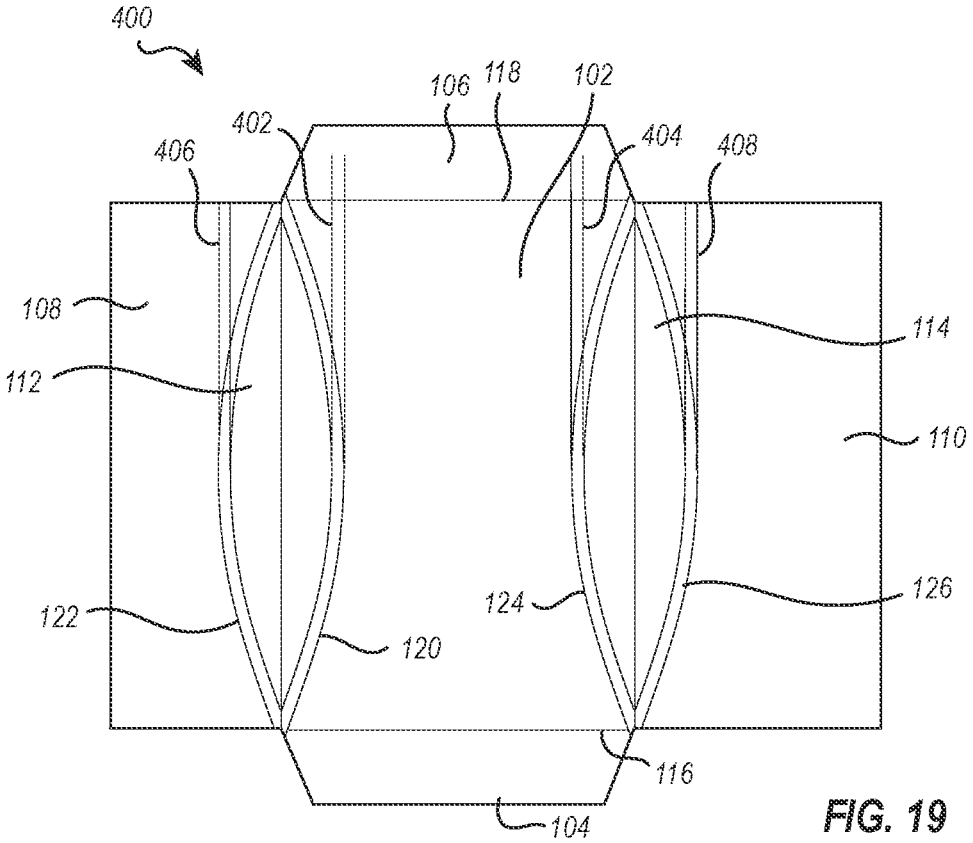

Attention is now directed to FIGS. 18 and 19, which illustrate an envelope template 400. More specifically, FIGS. 14 and 15 illustrate plan views of opposing sides of the template 300. The template 300 is substantially similar to the other templates disclosed herein. Accordingly, the description of the other templates is equally applicable to the template 400.

Similar to the template 200, the template 400 is formed with single wall corrugate. Also similar to the template 300, the template 400 includes creases 402, 402 in the central panel 102 that extend from or near the creases 120, 124 and towards the glue flaps 106.

Similar to the creases 402, 404, the template 400 may also include creases 406, 408 in the left and right panels 108, 110. For instance, the crease 406 may extend from or near the apex of the crease 122 towards the end of the template 400 that includes the glue flap 106. Likewise, the crease 408 may extend from or near the apex of the crease 126 towards the end of the template 300 that includes the glue flap 106. The creases 406, 408 may further facilitate placing the envelope formed with the template 400 into an open or expanded configuration. The ability of the envelope to fold along the creases 406, 408 may allow for the envelope to open even further.

The envelope templates and envelopes disclosed herein may be formed in a variety of different sizes and shapes. For instance, the envelopes may be about 20 inches long by 14.5 inches wide. 13 inches long by 9 inches wide. 6 inches long by 4 inches wide.

It will be appreciated that envelope templates or envelopes formed therewith according to the present disclosure may have any combination of features described in connection with the various specific embodiments disclosed herein. For instance, an envelope template or envelope may be formed of single face or single wall corrugate, may have one or more curved creases that divide panels thereof from one another, may have one or more creases that extend from or near a curved crease towards a first end of the template or envelope, may have one or more creases that divide one or more intermediate panels into multiple portions, and/or combinations of any of these various features.

In light of the disclosure herein, a foldable template for forming an envelope may include a central panel, a top glue flap, a bottom glue flap, a first intermediate panel, a second intermediate panel, a first back panel, and a second back panel. The top glue flap extends from a first end of the central panel and the bottom glue flap extends from a second end of the central panel. The first intermediate panel extend from a first side of the central panel and is separated from the central panel by a first curved crease. The second intermediate panel extends from a second side of the central panel and is separated from the central panel by a second curved crease. The first back panel extends from the first intermediate panel and is separated from the first intermediate panel by a third curved crease. The second back panel extends from the second intermediate panel and is separated from the second intermediate panel by a fourth curved crease.

In some embodiments, the first and second curved creases are curved in opposite directions from one another.

In some embodiments, the third and fourth curved creases are curved in opposite directions from one another.

In some embodiments, the first and third curved creases are curved in a same direction as one another.

In some embodiments, the second and fourth curved creases are curved in a same direction as one another.

In some embodiments, the first intermediate panel is defined by the first and second curved creases.

In some embodiments, the second intermediate panel is defined by the third and fourth curved creases.

In some embodiments, one or both of the first intermediate panel or the second intermediate panel has a generally lenticular shape.

In some embodiments, the template also includes a top glue flap crease separating the central panel and the top glue flap.

In some embodiments, the top glue flap crease has a first end and a second end.

In some embodiments, the template also includes a bottom glue flap crease separating the central panel and the bottom glue flap.

In some embodiments, the bottom glue flap crease has a first end and a second end.

In some embodiments, the first and second curved creases extend between the first ends of the top and bottom glue flaps creases.

In some embodiments, the third and fourth curved creases extend between the second ends of the top and bottom glue flaps creases.

In some embodiments, the first and second curved creases are spaced apart from and extend only partially between the first ends of the top and bottom glue flaps creases.

In some embodiments, the third and fourth curved creases are spaced apart from and extend only partially between the second ends of the top and bottom glue flaps creases.

In some embodiments, one or both of the first intermediate panel or the second intermediate panel has an oval, airfoil, tear-drop, or rhombus shape.

In some embodiments, a foldable template for forming an envelope includes a central panel, a top glue flap, a bottom glue flap, a first back panel, and a second back panel. The top glue flap extends from a first end of the central panel and the bottom glue flap extends from a second end of the central panel. The first back panel extends from a first side of the central panel and is separated from the central panel by one or more curved creases. The second back panel extends from a second side of the central panel and is separated from the central panel by one or more curved creases.

In some embodiments, the template also includes one or more creases disposed in the central panel and that extend from or near the one or more curved creases towards the top glue flap.

In some embodiments, the template also includes a crease disposed in each of the first back panel and the second back panel.

In some embodiments, the creases in the first and second back panels extend from or near the one or more curved creases towards an end of the template that includes the top glue flap.

In some embodiments, the template includes a first intermediate panel extending between the first side of the central panel and the first back panel.

In some embodiments, the first intermediate panel is separated from the central panel and/or the first back panel by the one or more curved creases that separate the first back panel from the central panel.

In some embodiments, the template includes a second intermediate panel extending between the second side of the central panel and the second back panel.

In some embodiments, the second intermediate panel is separated from the central panel and/or the second back panel by the one or more curved creases that separate the second back panel from the central panel.

In some embodiments, a foldable template for forming an envelope includes a central panel, a first end, a second end, first and second intermediate panels, first and second back panels, one or more curved creases, and one or more creases. The first end is disposed at a first end of the central panel. The second end disposed at a second end of the central panel. The first and second intermediate panels extend respectively from first and second sides of the central panel. The first and second back panels extend respectively from the first and second intermediate panels. The one or more curved creases are disposed between the central panel and the first intermediate panel, between the central panel and the second intermediate panel, between the first intermediate panel and the first back panel, or between the second intermediate panel and the second back panel. The one or more creases are formed in one or more of the central panel, the first back panel, or the second back. The one or more creases extend from or near the one or more curved creases towards the first end of the template.

In some embodiments, a curved crease of the one or more curved creases is disposed between each of the central panel and the first intermediate panel, the central panel and the second intermediate panel, the first intermediate panel and the first back panel, and the second intermediate panel and the second back panel.

In some embodiments, the one or more creases formed in one or more of the central panel, the first back panel, or the second back include first and second creases formed in the central panel.

In some embodiments, the one or more creases formed in one or more of the central panel, the first back panel, or the second back further include a crease formed in the first back panel and a crease formed in the second back panel.

Unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A foldable template for forming an envelope, comprising: a central panel;

a top glue flap extending from a first end of the central panel;

a bottom glue flap extending from a second end of the central panel;

a first intermediate panel extending from a first side of the central panel, the first intermediate panel being separated from the central panel by a first curved crease;

a second intermediate panel extending from a second side of the central panel, the second intermediate panel being separated from the central panel by a second curved crease;

a first back panel extending from the first intermediate panel, the first back panel being separated from the first intermediate panel by a third curved crease;

a second back panel extending from the second intermediate panel, the second back panel being separated from the second intermediate panel by a fourth curved crease; and one or more linear creases disposed in the central panel, at least one of the one or more linear creases having a first end disposed at a middle of the first or second curved crease, the at least one linear crease extending from the middle of the first or second curved crease towards the top glue flap.

2. The foldable template of claim 1, wherein the first and second curved creases are curved in opposite directions from one another and the third and fourth curved creases are curved in opposite directions from one another.

3. The foldable template of claim 1, wherein the first and third curved creases are curved in opposite directions from one another and the second and fourth curved creases are curved in opposite directions from one another.

4. The foldable template of claim 1, wherein the first intermediate panel is defined by the first and third curved creases and the second intermediate panel is defined by the second and fourth curved creases.

5. The foldable template of claim 1, wherein one or both of the first intermediate panel or the second intermediate panel has a generally lenticular shape.

6. The foldable template of claim 1, further comprising a top glue flap crease separating the central panel and the top glue flap, the top glue flap crease having a first end and a second end.

7. The foldable template of claim 6, further comprising a bottom glue flap crease separating the central panel and the bottom glue flap, the bottom glue flap crease having a first end and a second end.

8. The foldable template of claim 7, wherein the first and third curved creases extend between the first ends of the top and bottom glue flaps creases.

9. The foldable template of claim 7, wherein the second and fourth curved creases extend between the second ends of the top and bottom glue flaps creases.

10. The foldable template of claim 7, wherein the first and third curved creases are spaced apart from and extend only partially between the first ends of the top and bottom glue flaps creases.

11. The foldable template of claim 7, wherein the second and fourth curved creases are spaced apart from and extend only partially between the second ends of the top and bottom glue flaps creases.

12. The foldable template of claim 1, wherein the first intermediate panel has a crease disposed therein between the first and third curved creases and the second intermediate panel has a crease disposed therein between the second and fourth curved creases.

13. The foldable template of claim 1, wherein the template is formed of single face or single wall corrugate material.

14. A foldable template for forming an envelope, comprising: a central panel;

a top glue flap extending from a first end of the central panel;

a bottom glue flap extending from a second end of the central panel;

a first back panel extending from a first side of the central panel, the first back panel being separated from the central panel by one or more curved creases;

a second back panel extending from a second side of the central panel, the second back panel being separated from the central panel by one or more curved creases; and one or more linear creases disposed in the central panel, at least one of the one or more linear creases having a first end disposed at a middle of one of the one or more curved creases, the at least one linear crease extending from the middle of the curved crease towards an end of the template that includes the top glue flap.

15. The foldable template of claim 14, the one or more linear creases comprise a linear crease extending from or near a middle of each of the one or more curved creases and towards the end of the template that includes the top glue flap.

16. The foldable template of claim 14, further comprising one or more linear creases disposed in the first back panel or the second back panel.

17. The foldable template of claim 14, further comprising a first intermediate panel extending between the first side of the central panel and the first back panel, the first intermediate panel being separated from the central panel and/or the first back panel by the one or more curved creases that separate the first back panel from the central panel.

18. The foldable template of claim 17, further comprising a second intermediate panel extending between the second side of the central panel and the second back panel, the second intermediate panel being separated from the central panel and/or the second back panel by the one or more curved creases that separate the second back panel from the central panel.

19. The foldable template of claim 14, wherein the template is formed of single face or single wall corrugate material.

20. A foldable template for forming an envelope, comprising: a central panel;

a first end disposed at a first end of the central panel;

a second end disposed at a second end of the central panel;

first and second intermediate panels extending respectively from first and second sides of the central panel;

first and second back panels extending respectively from the first and second intermediate panels, one or more curved creases disposed between the central panel and the first intermediate panel, between the central panel and the second intermediate panel, between the first intermediate panel and the first back panel, or between the second intermediate panel and the second back panel; and one or more linear creases formed in one or more of the central panel, the first back panel, or the second back, the one or more linear creases extending from a middle of at least one of the one or more curved creases and towards the first end of the template.

21. The foldable template of claim 20, wherein the one or more curved creases comprise a curved crease disposed between the central panel and the first intermediate panel, a curved crease disposed between the central panel and the second intermediate panel, a curved crease disposed between the first intermediate panel and the first back panel, and a curved crease disposed between the second intermediate panel and the second back panel.

22. The foldable template of claim 21, wherein the one or more linear creases formed in one or more of the central panel, the first back panel, or the second back include first and second linear creases formed in the central panel.

23. The foldable template of claim 22, wherein the one or more linear creases formed in one or more of the central panel, the first back panel, or the second back further include a linear crease formed in the first back panel and a linear crease formed in the second back panel.

24. The foldable template of claim 20, wherein the template is formed of single face or single wall corrugate material.

* * * * *